US006511928B2

(12) United States Patent
Payet

(10) Patent No.: US 6,511,928 B2
(45) **Date of Patent: *Jan. 28, 2003**

(54) RAYON FABRIC WITH SUBSTANTIAL SHRINK-RESISTANT PROPERTIES

(75) Inventor: George L. Payet, Cincinnati, OH (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/163,319

(22) Filed: Sep. 30, 1998

(65) Prior Publication Data

US 2001/0001794 A1 May 24, 2001

(51) Int. Cl.[7] ..... D06M 13/12; D06M 13/507; B32B 27/00

(52) U.S. Cl. ..... 442/87; 442/59; 442/99; 442/106; 442/109; 442/152; 8/115.6; 8/116.4; 8/127.5; 8/127.6; 8/128.1; 8/128.3; 8/181; 8/183; 8/185

(58) Field of Search ..... 442/59, 87, 99, 442/106, 109, 152; 8/116.4, 181, 183, 115.6, 127.5, 127.6, 128.1, 128.3, 185

(56) References Cited

U.S. PATENT DOCUMENTS

| | | | | | |
|---|---|---|---|---|---|
| 2,243,765 | A | | 5/1941 | Morton | 536/56 |
| 3,663,974 | A | | 5/1972 | Watanabe et al. | 8/116.4 |
| 3,841,832 | A | | 10/1974 | Swidler et al. | 8/116.4 |
| 3,960,482 | A | * | 6/1976 | Payet | 8/116.4 |
| 4,039,496 | A | * | 8/1977 | Hermann | 8/183 |
| 4,072,466 | A | * | 2/1978 | Hermann | 8/183 |
| 4,108,598 | A | | 8/1978 | Payet | 8/115.7 |
| 4,184,004 | A | | 1/1980 | Pines et al. | 442/102 |
| 4,188,422 | A | * | 2/1980 | Wasley et al. | 28/167 |
| 4,269,602 | A | * | 5/1981 | Worth et al. | 8/116.4 |
| 4,295,847 | A | * | 10/1981 | Peterson et al. | 8/189 |
| 4,312,993 | A | | 1/1982 | Martin | 556/419 |
| 4,331,438 | A | * | 5/1982 | Pai | 8/187 |
| 4,331,797 | A | | 5/1982 | Martin | 528/26 |
| 4,396,390 | A | | 8/1983 | Hendrix et al. | 8/116.4 |
| 4,475,917 | A | * | 10/1984 | Ohshima et al. | 8/127 |
| 4,520,176 | A | * | 5/1985 | Martin et al. | 524/598 |
| 4,530,874 | A | * | 7/1985 | Hendrix et al. | 428/266 |
| 4,619,864 | A | | 10/1986 | Hendrix et al. | 442/157 |
| 5,021,263 | A | * | 6/1991 | Kastele et al. | 427/353 |
| 5,021,264 | A | * | 6/1991 | Kastele et al. | 427/353 |
| 5,376,144 | A | * | 12/1994 | McClain et al. | 8/116.4 |
| 5,458,544 | A | | 10/1995 | Fujiwara et al. | 474/205 |
| 5,480,485 | A | * | 1/1996 | McClain et al. | 118/64 |
| 5,879,410 | A | * | 3/1999 | Yanai et al. | 8/181 |
| 5,885,303 | A | * | 3/1999 | Payet | 8/116.4 |

FOREIGN PATENT DOCUMENTS

| | | | | |
|---|---|---|---|---|
| WO | 99/10589 | * | 3/1999 | D06M/13/127 |

* cited by examiner

*Primary Examiner*—Yogendra N. Gupta
*Assistant Examiner*—Brian P. Mruk
(74) *Attorney, Agent, or Firm*—Dinsmore & Shohl LLP

(57) ABSTRACT

A durable press process for rayon fiber-containing fabrics comprising treating a rayon fiber-containing fabric with an aqueous mixture containing a high concentration of formaldehyde, and a catalyst capable of catalyzing the crosslinking reaction between formaldehyde and the rayon, wherein the concentration of the formaldehyde is sufficient to produce a durable press fabric without substantially shrinkage of the treated fabric, followed by heat curing the treated fabric to produce a durable press rayon fabric without substantial shrinkage.

48 Claims, No Drawings

RAYON FABRIC WITH SUBSTANTIAL SHRINK-RESISTANT PROPERTIES

BACKGROUND OF THE INVENTION

1. Field of Invention

This invention relates to a durable press/wrinkle-free process for cellulosic fiber-containing fabrics and more particularly to a process which permits high treatment level amounts of formaldehyde and catalysts to impart wrinkle resistance to the cellulosic fiber-containing fabrics while reducing the loss in both tensile and tear strength normally associated with such treatment processes. The process of the present invention is particular adopted for the treatment of rayon and rayon blend fabrics.

2. Description of Related Art

There are a number of known processes for treating cellulosic fiber-containing fabrics, such as cotton-containing fabrics, to make them wrinkle-free. These treatment processes include resin or polymer treatment of the fabric, but these are costly and unsatisfactory. Another process for treating cellulosic fiber-containing products relies on formaldehyde to provide durable cross linking of the cellulose molecules and to thereby impart durable crease resistant and smooth drying characteristics to these products. However, problems have been encountered with the known processes, especially when applied to rayon. A simple, reproducible, completely satisfactory low-cost formaldehyde durable press process for rayon has not yet been achieved.

It has long been known to treat cellulosic materials with formaldehyde, as is evidenced by U.S. Pat. No. 2,243,765. This patent describes a process for treating cellulose with an aqueous solution of up to 40% formaldehyde and a small proportion of an acid catalyst under such conditions of time and temperature that the reaction is allowed to approach its equilibrium.

It is further stated that, in carrying out this process, the proportion of the solution of formaldehyde to the cellulose must be at least such that the cellulose is always in a fully swollen state. It is also stated that the time and temperature of the treatment with the solution of formaldehyde and acid catalyst will vary with one another, the time required increasing rapidly as the temperature diminishes. When it is desired, the product may be isolated by washing and drying; preferably at a temperature of about 212° F. The products obtained according to this process are said to show no increase in wet strength and possess a high water imbibition, no increased resistance to creasing and a slight increase in affinity to some direct dyes. There is no mention of rayon in this patent although it does mention that the cellulose material may be bleached wood pulp.

In recent years additional methods have been devised for treating cellulosic fiber-containing products in order to impart durable crease retention, wrinkle resistance and smooth drying characteristics to these products. As discussed, formaldehyde has been cross linked with cellulose materials to produce these products. It is also known to treat cellulose materials with resins or precondensates of the urea-formaldehyde or substituted urea-formaldehyde type to produce a resin treated durable press product.

Textile fabrics treated with durable press resins require treatment with softening agents to achieve commercially acceptable hand, strength, and wrinkle recovery. U.S. Pat. No. 4,184,004 describes the treatment of a durable press resin treated fabric with a softener which is a silicone compound which may be a hydrophilic organosilicone terpolymer which contains a plurality of reactive epoxy groups. U.S. Pat. No. 4,520,176 also describes the use of silicone softeners for the treatment of aminoplast resin treated fabrics. The silicone softeners are organopolysiloxanes which are capable of being cross-linked.

As noted in U.S. Pat. No. 3,841,832, while formaldehyde has made a significant contribution to the cotton finishing art, it has had virtually no impact with respect to rayon containing fabrics even though rayon and cotton may be considered cellulosic containing fibers. Even with respect to cotton, the result has been far from perfect. For instance, in some cases the formaldehyde crosslinking treatment has tended to lack reproducibility, since control of the formaldehyde cross-linking reaction has been difficult.

U.S. Pat. No. 4,396,390, points out that the lack of reproducibility is especially true on a commercial scale. Moreover, unacceptable loss of fabric strength has also been observed in many of the proposed aqueous formaldehyde treatment processes. When high curing temperatures were used with an acid or potential acid catalyst, excess reaction and degradation of the cotton often happened which considerably impaired its strength. On the other hand, when attempts were made to achieve reproducibility at temperatures of 106° F. or less, much longer reaction or finishing times were usually required, rendering the process economically relatively unattractive. A solution to this is set forth in U.S. Pat. No. 4,108,598, the entire disclosure of which is herein incorporated by reference. This patent specifically states that rayons, e.g. regenerated cellulose (both viscose and cuprammonium) may be treated by the process described therein but there is no exemplification of the treatment of rayon.

Rayon is chemically the same as cotton and for this reason one would expect that systems which are effective in treating cotton would also be effective in treating rayon. Rayon is made from wood pulp (cellulose) in which the original cellulose fibers are changed into a thick, syrupy solution that is pressed through a group of exceedingly fine openings called spinnerets to form long filaments. As these filaments emerge and solidify in an acidic liquid, they are put under tension and formed into strands. The strands are processed into yarns then woven into fabrics. However, rayon is a very amorphous fiber (its molecules are spread out) and rayon does not resemble cotton in the way it reacts, even though it is chemically the same as cotton. In fact, even though some of the prior art includes rayon as a possible cellulosic material to be treated with formaldehyde and acid catalysts, there is no commercially viable formaldehyde rayon treatment process and rayon is treated with resins to improve its properties. None of the above discussed patents contain examples which describe the treatment of rayon containing fabrics even though some of the patents refer to rayon containing fabrics as the type of fabric which may be treated by the process described in the patent.

Shrinkage is a very serious problem when aqueous systems are applied to rayon containing fabrics and because of this shrinkage, rayon containing fabrics generally require dry cleaning as opposed to washing in an aqueous solution, such as water and a detergent. This is a disadvantage for rayon fabrics and it would be a significant advance if rayon containing fabrics could be treated so as to make them washable in water and avoid the inconvenience and added expense of dry cleaning. When the fabric is made from 100% rayon fiber and subjected to aqueous washing, shrinkage may be as high as 18%–20%. The shrinkage problem is also severe with a polyester/rayon fabric, because the rayon shrinks so much, and the polyester shrinks so little, that the fabric becomes completely distorted due to the extreme difference in the rate of shrinkage of the two fibers which make the blended fabric. The fabric will not lay flat on aqueous washing, and manufactures are forced to require dry cleaning of a garment made from this type of fabric.

SUMMARY OF THE INVENTION

In accordance with the present invention it is possible to obtain good durable press properties in a rayon fiber-containing fabric with good strength retention with a process that produces consistent results and which controls shrinkage so that the resulting fabric may be cleaned using normal washing detergents and water and does not require that the fabric be dry cleaned. This invention relates to an aqueous durable press/wrinkle-free process for rayon fiber-containing fabrics and more particularly to a process which utilizes acid catalysts and high concentrations of formaldehyde. The formaldehyde concentration used in the process of the present invention is much higher than in the prior art durable press processes for the treatment of cotton containing fabrics. The invention includes the use of very active or hot catalysts in certain preferred aspects.

The invention also includes the fabrics treated by the process of the present invention. These rayon containing fabrics have unique properties including low shrinkage which makes them water washable and which provides a distinct commercial advantage to the rayon containing treated fabrics of the present invention.

In a further aspect of the invention, elastomers are used in the treatment process and especially silicone elastomers to reduce loss in both tensile and tear strength when subjecting the fabric to the durable press process of the present invention.

In another aspect of the invention, the fabric is moistened with water or an aqueous solution containing a wetting agent and the amount of moisture is controlled prior to the addition of the formaldehyde and acid catalysts. Strength enhancing additives such as urea and derivatives thereof may be added with the formaldehyde and acid catalysts in a still further aspect of the invention.

A problem associated with rayon fabrics and which has been overcome by the process of this invention is a reduction in the shine which develops when rayon fabrics are pressed with a hot iron. Rayon fabrics treated in accordance with the process of the present invention eliminate the "shine" which is developed on pressing a rayon fabric which has not been treated with the process. This is a further advantage of the process of the present invention.

DESCRIPTION OF PREFERRED EMBODIMENTS

The durable press process of the present invention for treating rayon containing fabrics, including 100% rayon fabric, comprises treating the rayon containing fabric with aqueous formaldehyde and a catalyst capable of catalyzing the crosslinking reaction between formaldehyde and cellulose, i.e., rayon. The concentration of the formaldehyde used in the process is much higher than the amount used in the prior art durable press processes for cotton, cellulose, containing fabrics. The effective treatment of rayon at such high formaldehyde and acid catalysts concentrations is totally unexpected because one skilled in the durable press art of cotton finishing with formaldehyde would have thought that the fabric would be completely destroyed at such high treatment levels, or at least rendered so weak that it would be commercially unacceptable. Obviously, the consumer will find a fabric with insufficient wear characteristics, such as durable press and strength, to be unacceptable. There are industry standards that fabrics must meet to be commercially acceptable. The treatment of rayon by the process of the present invention results in a novel treated rayon fabric which meets these standards and allows the treated fabric to be cleaned by conventional washing or laundering due to its stability to aqueous washing or laundering. Shrinkage of less than 2.5% may be achieved by the process of the present invention.

After the rayon containing fabric has been treated with the aqueous composition containing formaldehyde and acid catalysts, it is subjected to curing conditions. The rayon fiber-containing fabric, preferably having a moisture content of more than 20% by weight, is treated or cured under conditions at which formaldehyde reacts with the rayon in the presence of the catalyst, and without the substantial loss of formaldehyde before the reaction of formaldehyde with the rayon, to improve the wrinkle resistance of the fabric while reducing the loss in both tensile and tear strength. It is preferable that the rayon containing fabric is in the fully swollen state.

It is also preferable that an elastomer is present when the reaction with formaldehyde takes place and the elastomer may be applied to the fabric with the aqueous formaldehyde and catalyst solution. While any elastomer may be used, such as an acrylic elastomer, or a urethane elastomer; silicone elastomers are particularly preferred. Any silicone elastomer may be used in the present invention. Silicone elastomers are known materials. Silicone elastomers have a backbone made of silicon and oxygen with organic substituents attached to silicon atoms comprising n repeating units of the general formula:

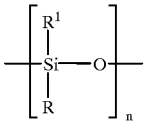

The groups R and $R^1$ may be the same or different and includes for example, lower alkyl, such as methyl, ethyl, propyl, phenyl or any of these groups substituted by hydroxy groups, fluoride atoms or amino groups; in other words, reactive groups to cellulose, i.e., rayon.

The silicones used to make the silicone elastomers in the present invention are made by conventional processes which may include the condensation of hydroxy organosilicon compounds formed by hydrolysis of organosilicon halides. The required halide can be prepared by a direct reaction between a silicon halide and a Grignard reagent. Alternate methods may be based on the reaction of a silane with unsatutrated compounds such as ethylene or acetylene. After separation of the reaction products by distillation, organosilicon halides may be polymerized by carefully controlled hydrolysis to provide the silicone polymers useful in the present invention.

For example, elastomers may be made by polymerization of the purified tertramer using alkaline catalysts at 212–302 degrees F., the molecular weight being controlled by using a monofunctional silane. Curing characteristics and properties may be varied over a wide range by replacing some methyl groups by —H, —OH, fluoroalkly, alkoxy or vinyl groups and by compounding with fillers as would be appreciated by one of ordinary skill in the art.

Silicone elastomers used in the present invention are high weight materials, generally composed of dimethyl silicone units (monomers) linked together in a linear chain. These materials usually contain a peroxide type catalyst which causes a linking between adjacent methyl groups in the form of methylene bridges. The presence of crosslinking greatly improves the durability of the silicone elastomer on rayon by producing larger molecules.

It is also possible to produce a reactive silicone elastomer, which is one where reactive groups capable of reacting with the substrate have been added to the linear dimethyl silicone polymer. These silicones are capable of reacting both with cellulose substrates as well as with most protein fibers, and are characterized by much greater durability of the silicone polymer on the substrate, even approaching the life of the substrate.

Another group of reactive silicone polymers are the hydrophilic organosilicone terpolymers which are elastomers and which contain a plurality of reactive epoxy groups and a plurality of polyoxyalkylene groups as described in U.S. Pat. No. 4,184,004, the entire disclosure of which is herein incorporated by reference. Other silicone elastomers which may be used in the process of the present invention include the ester containing silylated polyethers described in U.S. Pat. No. 4,331,797, the entires disclosure of which is herein incorporated by reference. Also incorporated by reference is the disclosure of U.S. Pat. No. 4,312,993 which describes silylated polyethers which may be used in the process of the present invention.

Silicone elastomers which give off reaction gases or chemicals indicating chemical reaction with the substrate are much preferred over non-reactive silicone elastomer, but this is not to say that non-reactive silicone elastomers cannot be used in the process. Different elastomers, purchased from different manufacturers have all shown increases in tensile as well as tear strength, as shown in the tables included herein. Elastomeric silicone polymers have been found to increase strength whereas simple emulsified silicone oils (or lubricants) do not give increases in tensile strength.

The aqueous system containing formaldehyde, an acid catalyst, silicone elastomer and a wetting agent may be padded on the fabric to be treated, preferably to insure a moisture content of more than 20% by weight on the fabric, and then the fabric cured. The silicone elastomer composition is contained in the aqueous system in an amount to provide from 0.1 to 5%, (0.053–2.65% solids OWF) preferably 1 to 2% (0.53–1.06% solids OWF) and most preferably, about 1.5%, (0.795% solids OWF), of the composition on the weight of the fabric.

The padding technique is conventional to the art and generally comprises running the fabric through the aqueous solution which is then passed through squeezing rollers to provide a wet pick-up of from about 50 to about 100% or more. As is conventional in the art, the concentration of the reactants in the aqueous solution are adjusted to provide the desired amount of reactants on the weight of the fabric (OWF).

In a preferred aspect of the invention, the fabric is pre-moistened before it is run through the chemical treatment bath containing the formaldehyde and catalysts. The premoistening is with water or an aqueous solution containing a wetting agent. Conventional wetting agents well known to one of ordinary skill in the art of durable press treating cotton with formaldehyde may be employed in the solution, generally in amounts of 0.1% (0.1% solids OWF) based on the weight of the solution. This results in an insignificant amount of wetting agent applied to the fabric, based on the weight of the fabric. This wetting agent insures that the treating solution will find its way into the fibers so that the entire fiber is treated with the treatment solution, and not just the outside of the fiber. (This would lead to a very poor treatment). Any non-ionic wetting agent can be used, ionic agents can cause break down of the treating solution, especially the elastomer, hence, the wetting agent should be carefully chosen, and tested in the laboratory as would be appreciated by one of ordinary skill in the art. This is a routine procedure, i.e., it requires no more than routine experimentation by one skilled in the art.

The pretreatment with the aqueous solution may be obtained by running the fabric through an aqueous bath and then through rollers to remove excess moisture or by the use of conventional low wet pick-up equipment, i.e., vacuum equipment etc., and to control the amount of moisture in the fabric prior to the application of the treatment chemicals in a separate bath. It is essential to know the moisture content of the fabric reaching the treatment bath so that the concentrations of the chemicals applied in the treatment bath can be determined and adjusted to insure that the correct amounts of reactants are on the fabric prior to curing to obtain the desired levels of treatment. The amount of moisture on the fabric prior to the application of the treatment chemical will dilute the amount of chemicals which the fabric "sees" after the pre-moistened fabric is run through the treatment bath.

The above procedure, which is called a wet on wet application of the aqueous chemicals, produced 13% higher strength than when the chemicals were applied to dry fabric. Shrinkage was considerably better when dealing with wet fabric, rather than dry.

Regardless of the reaction mechanism, one thing is known for sure, complete wetting and saturation is obtained when the fabric has been pre-wet, whereas on dry fabric, there is no guarantee that the fabric and all fibers are thoroughly saturated and swollen to the same degree. In fact, applicant found the dry fabric difficult to wet out evenly as it was padded with aqueous chemical treatment solutions. In the wet on wet application, water and wetting agent were applied first, giving time for complete saturation before the aqueous chemicals were applied.

While not wishing to be bound by any theory, if one were to visualize a fabric where there are spots of heavily wetted areas, next to areas that are not wet out. The heavily wet out areas contain more chemical than they should, as the application should have spread to the area where there is nothing, or less solution. Treatment where the chemical concentration is higher will be more severe than in an adjacent area where less chemicals are found. It is the poor wet out, or poor uniformity that leads to weak, or over treated micro areas as well as strong untreated areas in the fabric. The strength of the fabric is only as good as the weakest spot.

Now visualize a fabric that has been wet out to 50% with water before chemicals are applied, and are suddenly dipped in a two times concentration of chemicals, (two times stronger to account for the water already in the fabric). Now as the chemical solution is diluted two to one with the water in the fabric, not only is a normal concentration achieved, but the chemicals can move everywhere in and on the fibers. There are no concentrated areas, everything is equally treated, hence the chemical reaction will give a fabric without micro-weak spots. It is believed that this is how wet on wet treatments give higher strength.

It is noted that when treating dry fabric, that is fabric with an ambient amount of moisture, half the amount of formaldehyde was used, for reasons outlined above. (The pre-wet out fabric already contains water.) What is not clear is that in applying the aqueous mixture to dry fabric that one half of the catalyst concentration was not used. The reason for this is not so obvious. Catalyst concentration runs it's own curve and does not necessarily follow the formaldehyde curve precisely. It levels off sooner, hence if one half of the catalyst concentration used in wet on wet treatments had been used in the wet on dry treatments, there would not have been enough catalyst present to give a good reaction or good treatment. The concentration used is based on all the previous work which applicant has done on application of the aqueous mixture to a dry fabric. By consulting previous data, the appropriate catalyst concentration was chosen, and as the data shows, strengths, though a bit less than wet on wet treatments, are quite close. What is surprising is that shrinkage control in the dry fabric treatments is not as good. If the catalyst concentration had been cut in half, shrinkage would have been even worse.

As noted, the addition of urea to the treating solution results in a 30% increase in strength. Urea may be added to the aqueous treating composition to provide from 0.5 to 3% of urea on the weight of the fabric, preferably from 1–2% OWF. The mechanism of this strength increase is not known as yet, but it is totally reproducible on woven fabrics, and knits. The urea is first dissolved in water before adding to the treatment bath, and is added just before any wetting agent is added to the treatment bath. As noted above, a wetting agent may also be added in the premoistening step. Surprisingly, the use of urea left the fabric stronger by at least 30% in both tensile as well as tear strength. This effect of urea appears to be peculiar to the aqueous system of the present invention, as it does not give the increase in strength with other formaldehyde crosslinking processes. However, there is a very slight lessening of the DP value. It is a simple matter to increase the treatment, to account for the half point drop in DP and still realize the 30% strength increase.

While it is preferred to use urea, urea derivatives which are compatible with the aqueous system may also be used in comparable amounts which may be readily determine by one skill in the art based on the amount of urea added to the system. These derivatives include substituted ureas where one or more organic groups are substituted for one or more of the urea hydrogen atoms. Such organic groups include lower alkyl, i.e., methyl, ethyl, propyl, provided that the urea derivatives' water solubility in the aqueous system is not adversely effected. Similarly, thiourea and its water soluble derivatives may also be used.

The treatment level is largely dictated by the amount of formaldehyde used in the treating solution, but also by the amount of catalyst employed. Catalyst should be used in a ratio with the formaldehyde, e.g., more formaldehyde, more catalyst, etc. The other components, softener, urea and wetting agent have no effect on the level of treatment.

The level of treatment selected is dictated by the fabric, some fabrics can withstand high level of treatment, others cannot. The following are rules of thumb, but experimental trials should show what treatments can be used.

It is possible to use unexpected high temperatures which allow the crosslinking reaction to take place before the loss of formaldehyde is great enough to affect the process and provide inadequate treatment. In accordance with this aspect of the invention, the padded fabric may be immediately plunged into a heating chamber at from about 300 to about 350° F. This is an important commercial aspect of the invention as it enables continuous processing on a commercial scale at speeds of 5–50 yards per minute. It must be appreciated, that this process is designed for commercial applications which are demanding in that the process must be commercially viable.

This may also be accomplished by curing at a low temperature with an active catalyst. It is also possible to use any combination of techniques which prevent the substantial loss of formaldehyde during the curing. For example, a low temperature may be used in combination with an aqueous formaldehyde solution. It would also be possible to use a pressurized system wherein the pressure is greater than atmospheric, thereby preventing the substantial loss of formaldehyde before the formaldehyde crosslinks with the cellulosic fiber-containing fabric being treated.

Rayon fabrics treated by the process of the present invention contain 6000+ ppm after treatment but before steaming or cleaning the treated fabric.

It is known to add to the rayon containing fabric a polymeric resinous additive that is capable of forming a soft film. For example, such additives may be a latex or fine aqueous dispersion of polyethylene, various alkyl acrylate polymers, acrylonitrile-butadiene copolymers, deacetylated ethylene-vinyl acetate copolymers, polyurethanes and the like. Such additives are well known to the art and are generally commercially available in concentrated aqueous latexform. Such a latex is diluted to provide about 1 to 3% polymer solids in the aqueous catalyst-containing padding bath before the fabric is treated therewith. One known softener which was virtually the softener of choice in the durable press process using resin treatment or formaldehyde crosslinking was high density polyethylene, Mykon HD. It has been unexpectedly discovered that the substitution of a silicone elastomer for high density polyethylene significantly reduces the loss in tear strength of the treated fabric after washing as well as providing better control of the process as may be seen from the examples. The importance of good control of the process is essential to a commercially viable process to provide a consistent product from run to run which is not adversely affected by variations in atmospheric pressure, humidity and the like.

As the rayon fiber-containing fabric which may be treated by the present process there can be employed various rayons which are made by any of the known processes including the viscose and cuprammonium processes. Rayon produced by the Lyocell process may also be treated effectively by the process of the present invention. Other fibers which may be used in blends with one or more of the above-mentioned rayons are, for example, polyamides (e.g., nylons), polyesters, acrylics (e.g., polyacrylonitrile), polyolefins, polyvinyl chloride, and polyvinylidene chloride. Such blends preferably include at least 35 to 40% by weight, and most preferably at least 50 to 60% by weight, of rayon.

The fabric may be a resinated material but preferably it is unresinated; it may be knit, woven, non-woven, or otherwise constructed. After processing, the formed wrinkle resistant fabric will maintain the desired configuration substantially for the life of the fabric. In addition, the fabric will have an excellent wash appearance even after repeated washing.

This invention is not dependent upon the limited amounts of moisture to control the crosslinking reaction since the crosslinking reaction is most efficient in the most highly swollen state of the cellulose fiber. Lesser amounts of moisture may be used but are less preferred.

However, the silicone elastomer is preferably present in a sufficient amount to reduce the loss of tensile and tear strength in the fabric normally associated with the treatment of the same fabric in a prior art treatment process which may include the use of other softeners. The formulation and process of the present invention may be adjusted to meet specific commercial requirements for the treated fabric. For example, formaldehyde and the catalyst concentration may be increased to provide better treatment; then the concentration of the softener is also increased to combat the loss of tear strength caused by the increased amount of catalyst used in the process. This lends itself to computerized control of the systems for treating various fabrics and allows variation in the treatment of different fabrics, which is another advantage of the process of the present invention.

While simple emulsified silicone oils are known as silicone softeners and have found some use in fabric treatment, they suffer serious disadvantages in having a strong tendency to produce non-removable spots. However, the particular silicone elastomer used in the process of the present invention completely overcomes these problems.

Fabrics to be treated in accordance with the present invention are immersed in a solution to provide a pick up or on the weight of fabric (OWF) of about 14–20% formaldehyde, 3–10 % of catalyst, and optionally 1–10% of the silicone elastomer. This requires a pickup of about 50 to 100% or more by weight of the aqueous formulation to achieve the above stated percentage of reactants on the fabric. The curing temperature may be about 350° F. In fact, the padded fabric may be plunged into a oven or heating chamber at 350° F.

The formaldehyde concentration may be varied as would be appreciated by one of ordinary skill in the art. The process includes the use of formaldehyde in the form of an aqueous solution having a concentration of about 14% to 20%, by weight.

The preferred formaldehyde concentration on the fabric is from 15% to 18% based on the weight of the fabric (OWF).

The catalyst which may be used in the process may be selected from any of the known acid catalysts conventional to the art which includes fluorosilicic acid for mild reactions and is applicable to blend fabrics. A group of catalysts which may be used in the present invention include those described in U.S. Pat. No. 3,960,482, the entire disclosure of which is herein incorporated by reference and which include acid catalysts including acid salts such as ammonium, magnesium, zinc, aluminum and alkaline earth metal chlorides, nitrates, bromides, bifluorides, sulfates, phosphates, and fluorborates. Magnesium chloride, aluminum and zirconium chlorohydroxide and mixtures thereof may also be used.

Water soluble acids which function as catalysts in the present process include both inorganic and organic acids such as sulfamic acid, phosphoric acid, hydrochloric acid, sulfuric acid, adipic acid, fumaric acid, citric acid, tartaric acid and the like may also be used. The catalysts may be used alone or in combination as can be readily determine by one of ordinary skill in the art.

On heavyweight, all-rayon fabrics, or shirting fabrics, a catalyst such as magnesium chloride spiked with citric acid can be used, which is a commercially available catalyst, Freecat LF. Freecat No. 9, is another magnesium chloride catalyst which contains aluminum/magnesium chloride. These catalysts are available from Freedom Textile Chemicals.

During the crosslinking reaction at the curing stage, moisture is given up from the fabric as the crosslinking occurs, resulting in a decrease in the moisture content of the fabric. Of course, water is not allowed to be present in so much of an excess as to cause the catalyst to migrate on the fabric.

Catalyst LF is a particularly active or "Hot" version of the magnesium chloride catalyst used in conventional formaldehyde treatment process of cotton and it contains magnesium chloride salt and an organic acid, such as citric acid to boost the acidity. Other acids may also be used. Catalyst LF was developed to cure the hard-to-react low formaldehyde resins. Oddly enough, one would expect that since it is more acid than Catalyst No. 9, (magnesium chloride only) that it would cause greater damage and more strength loss. This is not the case, this catalyst more often than not produce higher treatment and better strength.

All test results reported in the following examples were obtained by the following standard methods:

1. Appearance of Fabrics after Repeated Home Laundering: AATCC Test Method 124–1992
2. Tensile Strength: ASTM: Test Method D-1682–64 (Test 1C)
3. Tear Strength: ASTM: Test Method D-1424–83 Falling Pendulum Method
4. Shrinkage: AATCC Test Method 150–1995
5. Wrinkle Recovery of Fabrics: Recovery Angle Method: AATCC Test Method 66–1990 which provides the DP value.

In determining the DP value for the fabrics, a visual comparative test is performed under controlled lighting conditions in which the amount of wrinkles in the treated fabric is compared with the amount of wrinkles present on pre-wrinkled plastic replicas. The plastic replicas have various degrees of wrinkles and range from a value of 1 DP for a very wrinkled fabric to 5.0 DP for a flat wrinkle free fabric. The higher the DP value, the better. For a commercially acceptable wrinkle free fabric, a DP value of 3.5 is desired but rarely achieved. As would be appreciated by one of ordinary skill in the art, the difference between a DP of 3.50 and 3.25 is significant. At DP 3.50 all wrinkles are rounded and disappearing. At DP 3.25 all wrinkles are still visible and show sharp creases. The goal for commercial acceptance for a cotton fabric is a DP of 3.50 with a filling tensile strength 25 pounds and a filling tear strength of 24 ounces. (Prior to this invention there was no DP for rayon since it could not be treated by formaldehyde DP processes). Of equal or even greater importance to these properties is that the process must be consistently reproducible on an industrial scale.

Moreover, shrinkage control is very important property and DP values which would not be acceptable for treated cotton become acceptable for rayon provided that shrinkage is controlled.

In all of the following examples a non-ionic wetting agent was used as is conventional to the art. The wetting agent was used in an amount of about 0.1 % by weight. The wetting agent used in all of the examples was a trimethyl nonanolethoxylate such as Union Carbide Tergitol TMN6. The wetting agent is used to cause complete wetting by the aqueous treating solution of the fibers in the fabric.

All of the samples were run on rayon containing fabrics. The normal industry standard for tear and tensile strength for a rayon shirting fabric is characterized by having a filling tensile strength of at least 25 pounds. The reaction conditions and test results are set forth in the tables.

The silicone elastomer was the commercially available dimethyl silicone emulsion sold by General Electric with a product number SM2112. This material is added as an opaque white liquid which contains from 24–26% silicone elastomer, has a pH of from 5.0–8.0 and is readily dilutable with water. Another commercially available silicone elastomer is Sedgefield Elastomer Softener ELS.

The catalysts used in the treatment process was obtained commercially as Catalyst LF which is an aqueous solution of magnesium chloride and citric acid.

Formaldehyde was in the form of an aqueous solution which was prepared from commercially available Formalin which is a 37% aqueous formaldehyde solution.

As is conventional in the art, all percentages given in the examples and tables are based on the product or chemicals as receive from the manufacture. The percentage is weight percent and in most instances is based on the weight of fabric being treated, except for the wetting agent which is added as a weight percent of the bath from which it is applied. The following examples are being presented not as limitations but to illustrate and provide a better understanding of the invention.

The amount of pick up of the treating solution from the bath by the fabric was determined by running the fabric through a padding bath containing only water and then through the squeeze rollers. The weight of a specific amount of dry fabric is determined and compared to the same amount of fabric after going through the padding bath and squeeze rollers. This amount of pick-up is expressed as percentage pick-up. For example, 90% pick up means that the fabric picks up 90% of its original weight after moving through the padding bath and through the squeeze rollers. Obviously the amount of pick-up will depend on how fast the fabric moves through the bath and the nip between the rollers. These parameters may be adjusted to control the amount of pick-up which in turn controls the concentration of chemicals in the padding bath to control the percentage of chemicals which are on the weight of the fabric. The techniques for making these adjustments are well known in the art and one of ordinary skill in the art would appreciate that it is necessary to know the amount of pick-up so that the amount of chemicals on the weight of the fabric (OWF) can be determined and thereby control the reaction on the fabric and obtain the desired results.

EXAMPLE 1

Four samples of a rayon Challis fabric measuring 18×36 inches were padded with a treatment solution and run through squeeze rollers to provide the amount of treatment chemicals as indicated in the Table I. The treated fabric was applied to a pin frame and cured in an oven at the temperatures indicated.

The pinned fabric was removed from the oven and then from the pin frame. The physical properties of the treated fabric were measured and recorded and are shown in TABLE I.

It is clear from Table I that increasing the amount of formaldehyde on the weight of the fabric (OWF) improves the DP value but reduces the strength of the fabric. This is also true with respect to the amount of shrinkage and the results show an entirely unexpected combination of DP and reduction in shrinkage.

EXAMPLE 2

Samples were prepared as in example 1 but from a rayon flax fabric with the necessary amounts of chemicals to provide the OWF values shown in Table II. The curing temperature is 300 degrees and the dwell time was varied. The results are shown in TABLE II.

EXAMPLE 3

Lenzing Lyocell rayon fabric was treated in accordance with the process of example 1 to provide the amounts of chemicals OWF as indicated in Table III. Table III shows the effectiveness of the process on Lyocell rayon.

EXAMPLE 4

A rayon and acetate fabric was treated in accordance with the process of example 1 to provide the amounts of chemicals OWF as indicated in Table IV. Table IV shows the effectiveness of the process on rayon acetate fabrics.

EXAMPLE 5

A 50/50 rayon/polyesterfabricwas treated in accordance with the process of example 1 to provide the amounts of chemicals OWF as indicated in Table V. Table V shows the effectiveness of the process on rayon/polyester fabrics.

TABLE I

| Sample No. | CH2O % OWF | Cat LF % OWF | SM2112 % OWF | Urea % OWF | Cure/Time Deg F/Min | Tensile or Burst Strength | Tear or % Loss Burst Str. | Shrink 5 Wash W × F | DP 5 Wash |
|---|---|---|---|---|---|---|---|---|---|
| 778 | 10.0 | 3.4 | 15 | 2.0 | 300/10 | 81.5 × 75.3 | 108.4 × 107.2 | 2.83 × +0.25 | 3.25 |
| 779 | 15.0 | 4.3 | 1.5 | 2.0 | 300/10 | 74.3 × 69.2 | 84.0 × 87.4 | 1.25 × +0.67 | 3.50 |
| 780 | 20.0 | 5.1 | 1.5 | 2.0 | 300/10 | 67.8 × 50.5 | 72.7 × 59.1 | 0.50 × +0.16 | 4.00 |
| 777 | Control | — | — | — | — | 86.7 × 77.2 | 74.5 × 59.1 | 18.25 × 8.42 | 1.00 |

TABLE II

| Sample No | CH2O % OWF | Cat LF % OWF | SM2112 % OWF | Urea % OWF | Cure 300° F. Min | Tensile, Lb. W × F | Tear, Oz W × F | Shrink 1-W W × F | DP 1-Wash |
|---|---|---|---|---|---|---|---|---|---|
| 959 | 15.0 | 4.3 | 1.5 | 1.0 | 10.0 | 107.0 × 71.0 | 128.2 × 95.5 | 0.17 × +0.91 | 3.50 |
| 960 | 15.0 | 4.3 | 1.5 | 1.0 | 7.5 | 111.7 × 70.0 | 119.9 × 100.9 | 0.42 × +0.75 | 3.50 |
| 961 | 15.0 | 4.3 | 1.5 | 1.0 | 5.0 | 117.5 × 77.2 | 138.4 × 119.0 | 0.83 × +0.50 | 3.25 |
| 962 | 15.0 | 4.3 | 1.5 | 1.0 | 2.5 | 124.5 × 83.8 | 183.5 × 146.1 | 2.00 × 0.33 | 3.00 |

TABLE III

| Sample No. | CH2O % OWF | Cat LF % OWF | SM2112 % OWF | Urea % OWF | Cure/Time Deg F/Min | Tensile, Lb. W × F | Tear Oz. W × F | Shrink 1-Wash W × F | DP 1-Wash | Shrink 5-Wash W × F | DP 5-Wash |
|---|---|---|---|---|---|---|---|---|---|---|---|
| 945 | 15.0 | 4.3 | 1.5 | 1.0 | 280/10 | 87.0 × 49.7 | 105.0 × 67.1 | 0.42 × +0.17 | 4.0 | 0.17 × +0.65 | 3.50 |
| 946 | 15.0 | 4.3 | 1.5 | 1.0 | 300/10 | 76.8 × 34.7 | 68.2 × 51.5 | 0.00 × +0.17 | 4.0 | 0.25 × 0.50 | 3.50 |
| 947 | 15.0 | 4.3 | 1.5 | 1.0 | 300/10 | 74.6 × 42.0 | 86.22 × 54.9 | 0.17 × +0.17 | 4.0 | 0.17 × 0.50 | 4.00 |
| 948C | — | — | — | — | — | 120.8 × 80.8 | 60.5 × 37.7 | 2.92 × 2.00 | 1.0 | 4.00 × 1.25 | 1.00 |

TABLE IV

| Sample No. | Frabic and Color | CH2O % OWF | Cat LF % OWF | SM2112 % OWF | Urea % OWF | Cure/Time Deg F/Min | Tensile, Lb. W × F | Tear Oz. W × F | Shrinkage 1-Wash W × F | DP 1-Wash | Shrinkage 5-Wash W × F | DP 5-Wash |
|---|---|---|---|---|---|---|---|---|---|---|---|---|
| 728 | R&A Tan Union | 15.0 | 4.3 | 1.5 | 1.0 | 300/10 | 44.7 × 22.0 | 64.3 × 44.7 | 1.92 × 0.17 | 4.00 | 2.83 × 0.42 | 3.50 |
| 728C | Control | — | — | — | — | — | 74.0 × 49.0 | 77.2 × 108.4 | 19.91 × 13.2 | 1.00 | 19.6 × 29.0 | <1.00 |
| 729 | R&A Tan Plaid | 15.0 | 4.3 | 1.5 | 1.0 | 300/10 | 41.3 × 23.5 | 76.8 × 41.8 | 1.25 × 0.58 | 3.75 | 1.92 × 1.25 | 3.50 |
| 729C | Control | — | — | — | — | — | 82.3 × 50.8 | 95.5 × 110.2 | 20.1 × 7.93 | 1.50 | 20.0 × 14.2 | 1.00 |
| 730 | R&A Tan Check | 15.0 | 4.3 | 1.5 | 1.0 | 300/10 | 47.7 × 22.7 | 72.2 × 59.1 | 1.00 × 2.00 | 3.50 | 1.25 × 2.42 | 3.25 |
| 730C | Control | — | — | — | — | — | 76.3 × 44.5 | 83.5 × 94.8 | 14.0 × 8.83 | 1.00 | 19.2 × 13.1 | 1.00 |
| 731 | R&A Pink Plaid | 15.0 | 4.3 | 1.5 | 1.0 | 300/10 | 42.2 × 23.5 | 85.8 × 58.2 | 1.58 × 2.75 | 3.25 | 3.00 × 3.58 | 3.00 |
| 731C | Control | — | — | — | — | — | 66.0 × 42.7 | 90.8 × 51.2 | 9.25 × 17.2 | <1.00 | 13.3 × 28.1 | <1.00 |
| 732 | R&A Charcoal Union | 15.0 | 4.3 | 1.5 | 1.0 | 300/10 | 39.0 × 22.7 | 72.2 × 46.3 | 1.75 × 0.50 | 5.00 | 2.42 × 0.33 | 5.00 |
| 732C | Control | — | — | — | — | — | 72.8 × 45.3 | 93.2 × 104.4 | 14.42 × 19.7 | 1.00 | 19.8 × 26.5 | <1.00 |
| 733 | R&A Grey Houndstooth | 15.0 | 4.3 | 1.5 | 1.0 | 300/10 | 41.5 × 22.7 | 68.4 × 22.7 | 0.67 × 3.83 | 3.25 | 1.25 × 5.00 | 3.40 |
| 733C | Control | — | — | — | — | — | 73.2 × 43.3 | 106.6 × 87.4 | 6.33 × 6.58 | 1.50 | 10.8 × 11.7 | 1.00 |
| 734 | R&A Black/White Plaid | 15.0 | 4.3 | 1.5 | 1.0 | 300/10 | 40.0 × 27.8 | 67.1 × 58.7 | 1.50 × 3.00 | 5.00 | 1.92 × 4.17 | 5.00 |
| 734C | Control | — | — | — | — | — | 72.0 × 47.3 | 74.0 × 66.2 | 12.75 × 12.25 | 1.00 | 18.5 × 18.5 | 1.50 |

TABLE V

| Sample No. | CH2O % OWF | Cat LF % OWF | SM2112 % OWF | Urea % OWF | Cure/Time Deg F/Min | Tensile, Lb. W × F | Tear Oz. W × F | Shrink 1-Wash W × F | DP 1-Wash | Shrink 5-Wash W × F | DP 5-Wash |
|---|---|---|---|---|---|---|---|---|---|---|---|
| 714 | — | — | — | — | — | 73.5 × 54.0 | No Tear* | 3.33 × 5.67 | <1.00 | 3.33 × 7.25 | <1.00 |
| 715 | 8.0 | 2.8 | 1.5 | 1.0 | 300/10 | 55.0 × 36.5 | N.T. | 1.42 × 0.83 | 2.00 | 1.75 × 1.33 | 2.00 |
| 716 | 10.0 | 3.4 | 1.5 | 1.0 | 300/10 | 49.8 × 28.0 | N.T. | 1.25 × 0.92 | 2.00 | 1.33 × 0.92 | 2.00 |
| 717 | 12.0 | 3.8 | 1.5 | 1.0 | 300/10 | 42.0 × 38.0 | N.T. | 0.83 × 0.58 | 3.00 | 0.58 × 1.50 | 3.00 |
| 718 | 15.0 | 4.3 | 1.5 | 1.0 | 300/10 | 40.2 × 28.3 | N.T. | 0.83 × 0.92 | 5.00 | 1.08 × 1.33 | 5.00 |
| 719 | 20.0 | 5.1 | 1.5 | 1.0 | 300/10 | 36.0 × 27.0 | N.T. | 0.92 × 0.92 | 5.00 | 0.83 × 0.92 | 5.00 |

*Note: Tear value exceed the capacity of the Elmendorff Tester.
**Note: DP is based on reduction of the waffle effect, not on wrinkling as there is none.

This example shows the effect on a 50/50 polyester/rayon fabric which previously could not be sell as a washable fabric. These fabrics are not an intimate blend of rayon and polyester fibers, but woven such that some of the areas are 100% polyester and other are 100% rayon. The rayon shrinks on water washing, the polyester does not. The difference in this shrinkage of the two fibers causes severe puckering of the fabric, making it resemble a waffle. This fabric is normally sold as a "drycleanable" fabric but when treated in accordance with the present process results in a new product which will be washable.

EXAMPLE 6

A rayon and flax (85/15) fabric was treated in accordance with the process of example 1 to provide the amounts of chemicals OWF as indicated in Table VI. Table VI shows the effectiveness of different embodiments of the process on a rayon containing fabric.

The results in the table shows the effectiveness of the process using only formaldehyde and catalyst to achieve results which surpasses the industry strength standards and produces a DP value of 3.5 which would be acceptable to the industry.

The results in the table show that on rayon containing fabrics, run with only formaldehyde and catalyst, achieve a fabric which surpasses the industry strength standards, and produces a DP value of 3.5. This fabric would be acceptable to the industry.

The table also shows that when silicone elastomer is added to the formaldehyde and catalyst, considerably higher strengths are realized and a DP of 4.00 is obtained.

Adding urea alone to the formaldehyde and catalyst results in higher tensile strength, but lower tear strength than obtained with the silicone, as would be expected as the urea makes the fabric somewhat stiffer. The results, however, are better than with the formaldehyde and catalyst alone. DP is not improved by the addition of urea.

When the preferred embodiment, formaldehyde, catalyst, silicone SM2112 and urea are used in the mix, the overall best results are obtained with both tensile and tear strength indicating a possible synergistic effect with the silicone and the urea. The DP is again boosted to 4.00 by the presence of the silicone.

Shrinkage was remarkably constant throughout all samples, showing extensions of approximately the same magnitude as compared to shrinkage of 6.42% on the untreated control.

TABLE VI

| Sample No. | CH2O % OWF | Cat LF % OWF | SM2112 % OWF | Urea % OWF | Tensile, Lb W × F | Tear Oz. W × F | Shrink 1-Wash W × F | DP** 1-Wash |
|---|---|---|---|---|---|---|---|---|
| 969 | 18.0 | 5.4 | — | — | 69.5 × 50.0 | 53.1 × 41.8 | +0.33 × +1.08 | 3.50 |
| 970 | 18.0 | 5.4 | 15 | — | 76.2 × 49.8 | 87.4 × 74.5 | +0.58 × +1.00 | 4.00 |
| 971 | 18.0 | 5.4 | — | 1.0 | 77.5 × 59.3 | 61.0 × 55.8 | +0.50 × +1.33 | 3.50 |
| 972 | 18.0 | 5.4 | 1.5 | 1.0 | 85.0 × 59.8 | 97.8 × 76.1 | +0.41 × +1.17 | 4.00 |
| control | — | — | — | — | 93.8 × 68.5 | 72.2 × 65.0 | 6.42 × 1.91 | 1.00 |

Note:
Shrinkage with a "plus" sign indicates that the fabric extended, did not get smaller.

EXAMPLE 7

Two rayon fabrics were tested by pressing in the hot head press at 350 degrees F. for 15 seconds. This pressing caused a severe shine in both fabrics, but it was more noticeable in the black butcher linen. Pressing after these fabrics had been treated with the process of the present invention produced no noticeable shine as summarized in the following table.

TABLE VII

Propensity for Glazing Rayon Fabrics by Pressing.

| Fabric/Color | Untreated Unpressed | Untreated Pressed | Treated Pressed |
|---|---|---|---|
| Rayon Twill/White | Slight Shine* | High Shine | Slight Shine |
| Rayon Linen/Black | No Shine | High Shine | No Shine |

*The slight shine in the original fabric is due to the bright rayon fibers used. The pressing did, however increase the shine, but the treatment of the present invention did not show the increased shine, and looked like the original fabric.

It is clear that treatment in accordance with the present invention either retards shining by pressing, or eliminates it altogether. Shinning is a serious problem with rayon fabrics not only by the consumer but in the processing mill where glazed spots appear wherever the fabric touches hot metal.

Rayon fibers exhibit molecular movement when under heat and pressure, thus deforming the fibers, making flat spots. If enough flat spots are produced, the fiber begins to act like a mirror and instead of reflecting light in all directions it makes the light reflect in one direction, causing a bright "shine". If severe enough, as in the case of the black fabric, a total change of shade occurs.

The process of the present invention, with its molecular crosslinking abilities renders the molecular structure rigid, so that when the fabric is pressed, the molecules cannot move, thus no flat spots are produced, and the fabric look the same as the original unpressed fabric.

This property is extremely valuable, as rayon pressing shine has been a problem since rayon appeared on the market in the late 1920's or 1930's. One might surmise that with the extensive crosslinking furnished by the process of the present invention that the Non-Shine effect would be far better than can be obtained with resins, where much of the smoothness comes from the presence of resin in the largely amorphous rayon fiber. That is why rayon fabrics which are washed, and loose the resins, shine badly when pressed by hand iron.

What is claimed is:

1. A fabric comprising rayon fibers, which fabric exhibits a shrinkage of less than 2.5% when subjected to aqueous laundering and has a filling tensile strength of at least 25 pounds, wherein the fabric is unresinated and is provided with a silicone elastomer.

2. A fabric according to claim 1, wherein the fabric has a durable press value of from 3.5 to 5 after 5 launderings.

3. A fabric according to claim 1, wherein the rayon fabric is treated with a composition comprising formaldehyde and catalyst.

4. A fabric according to claim 3, wherein the composition comprises from about 5.18% to about 7.4%, by weight, formaldehyde.

5. A fabric according to claim 3, wherein the rayon fabric exhibits decrease shine due to pressing as compared to untreated rayon fabric.

6. A fabric according to claim 3, wherein the composition consists essentially of water, formaldehyde, silicone elastomer and catalyst.

7. A fabric according to claim 1, wherein the rayon fibers are cross-linked.

8. A fabric according to claim 1, wherein the fabric exhibits a warp shrinkage in the range of from 0.17 to 3.00 and a fill shrinkage in the range of from 0.16 to 7.25 after 5 launderings.

9. A fabric comprising cross-linked rayon fibers, wherein the fabric exhibits decreased shine due to pressing as compared to rayon fabric free of cross-linked rayon fibers, and wherein the fabric is unresinated and is provided with a silicone elastomer.

10. A fabric according to claim 9, wherein the fabric is treated with a composition comprising formaldehyde and catalyst.

11. A fabric according to claim 9, wherein the fabric does not substantially shrink when subjected to aqueous laundering.

12. A fabric according to claim 11, wherein the fabric has a durable press value of from 3.5 to 5 after 5 launderings.

13. A fabric comprising rayon fibers, wherein the fabric is treated by the process comprising the steps of:

(a) contacting the fabric with a liquid composition comprising catalyst and from about 5.18% to about 7.4%, by weight, formaldehyde; and (b) heat curing the fabric; wherein the fabric is provided with silicone elastomer and is unresinated.

14. A fabric according to claim 13, wherein prior to the step of heat curing, the fabric has a moisture content of more than 20%, by weight.

15. A fabric according to claim 13, wherein the fabric is moistened prior to the step of contacting the fabric with liquid composition.

16. A fabric according to claim 13, wherein after the fabric is treated, the fabric does not substantially shrink when subjected to aqueous laundering.

17. A fabric according to claim 13, wherein the fabric has a filling tensile strength of at least 25 pounds.

18. A fabric according to claim 13, wherein the liquid composition further comprises an amount of silicone elastomer composition sufficient to provide from 0.1% to 5%, on weight of fabric, solids.

19. A fabric according to claim 13, wherein the liquid composition further comprises a dimethyl silicone elastomer emulsion.

20. A fabric according to claim 19, wherein the liquid composition comprises the dimethyl silicone elastomer emulsion at a level sufficient to provide from 0.053% to 2.65%, on weight of fabric, silicone solids.

21. A fabric comprising rayon fibers, wherein the fabric is treated by the process comprising the steps of:

(a) contacting the fabric with a liquid composition comprising catalyst and from about 5.18% to about 7.4%, by weight, formaldehyde;

(b) heat curing the fabric; and (c) cleaning the fabric after heat curing, wherein the fabric is provided with silicone elastomer and is unresinated.

22. A fabric according to claim 21, wherein the fabric comprises greater than 6000 ppm formaldehyde prior to the step of cleaning the fabric.

23. A fabric comprising rayon fibers, wherein the rayon fibers are treated with a liquid composition comprising catalyst and formaldehyde, and wherein the fabric is provided with silicone elastomer and is unresinated.

24. A fabric according to claim 23, wherein the composition comprises from about 14% to about 20%, by weight, formalin, and wherein the formalin comprises 37%, by weight, formaldehyde.

25. A fabric according to claim 23, wherein the fabric exhibits decreased shine due to pressing as compared to untreated rayon fabric.

26. A formaldehyde cross-linked fabric comprising rayon fibers, wherein the fabric is unresinated, is provided with silicone elastomer and exhibits decreased shine due to pressing as compared to fabric which is not cross-linked and which comprises rayon fibers.

27. A formaldehyde cross-linked fabric according to claim 26, wherein the fabric does not substantially shrink when subjected to aqueous laundering.

28. A formaldehyde cross-linked fabric according to claim 27, wherein the fabric exhibits warp shrinkage of from 0.17 to 3.00 after 5 launderings.

29. A formaldehyde cross-linked fabric according to claim 26, wherein the fabric has a durable press value of from 2 to 5 after 5 lauinderings.

30. A fabric comprising rayon fibers, wherein the fabric undergoes reduced glazing during processing, and wherein the fabric is unresinated and is provided with silicone elastomer.

31. A fabric according to claim 30, wherein the rayon fibers are treated with a composition comprising formaldehyde and catalyst.

32. A fabric according to claim 31, wherein the composition comprises from about 5.18% to about 7.4%, by weight, formaldehyde.

33. A fabric according to claim 30 wherein the fabric exhibits a warp shrinkage in the range of from 0.17 to 3.00 and a fill shrinkage in the range of from 0.16 to 7.25 after 5 launderings.

34. A fabric according to claim 30, wherein the rayon fibers are treated with a composition consisting essentially of water, formaldehyde and catalyst.

35. A fabric according to claim 30, wherein the fabric has a filling tensile strength of at least 25 pounds.

36. A fabric comprising rayon fibers, wherein the fabric is treated with a composition consisting essentially of water, formaldehyde, catalyst and dimethyl silicone emulsion, and wherein the dimethyl silicone emulsion provides the fabric with a silicone elastomer.

37. A fabric according to claim 36, wherein the dimethyl silicone emulsion is present in the composition at a level sufficient to provide from 0.053% to 2.65%, on weight of fabric, silicone solids.

38. A fabric according to claim 36 wherein the fabric exhibits a warp shrinkage in the range of from 0.17 to 3.00 and a fill shrinkage in the range of from 0.16 to 7.25 after 5 launderings.

39. A fabric comprising a silicone elastomer and cross-linked rayon fibers, wherein the cross-linked rayon fibers are provided by treating rayon fibers with a composition consisting essentially of water formaldehyde and catalyst.

40. A fabric according to claim 39, wherein the silicone elastomer is provided by treating the fabric with a dimethyl silicone emulsion.

41. A fabric according to claim 39, wherein the fabric exhibits a warp shrinkage in the range of from 0.17 to 3.00 and a fill shrinkage in the range of from 0.16 to 7.25 after 5 launderings.

42. A fabric comprising rayon fibers, wherein the fabric has a durable press property, wherein the durable press property is essentially provided by formaldehyde cross-linkages between rayon fibers, and wherein the fabric is unresinated an is provided with a silicone elastomer.

43. A fabric comprising cross-linked rayon fibers, wherein the fabric is provided with a silicone elastomer, has a filling tensile strength of at least 25 pounds, and is unresinated.

44. A fabric according to claim 43, wherein the fabric exhibits a warp shrinkage in the range of from 0.17 to 3.00 and a fill shrinkage in the range of from 0.16 to 7.25 after 5 launderings.

45. A fabric comprising rayon fibers, wherein the fabric is treated by a process comprising:

(a) contacting the fabric with a liquid composition comprising catalyst, formaldehyde and silicone elastomer emulsion; and (b) heat curing the wet fabric, wherein the fabric is unresinated and is provided with a silicone elastomer.

46. A fabric according to claim 45, wherein prior to the step of heat curing, the fabric has a moisture content of more than 20%, by weight.

47. A fabric according to claim 45, wherein after the fabric is treated, the fabric does not substantially shrink when subjected to aqueous laundering.

48. A fabric according to claim 47, wherein after the fabric is treated, the fabric exhibits a shrinkage of less than 2.5% when subjected to aqueous laundering and has a filling tensile strength of at least 25 pounds.

* * * * *